United States Patent [19]

Hanano

[11] Patent Number: 5,039,435

[45] Date of Patent: Aug. 13, 1991

[54] DIE-CASTING POWDERY MOLD RELEASING AGENT

[75] Inventor: Takashi Hanano, Kobe, Japan

[73] Assignee: Hanano Commercial Co., Ltd., Hyogo, Japan

[21] Appl. No.: 344,564

[22] Filed: Apr. 28, 1989

[30] Foreign Application Priority Data

Jan. 13, 1989 [JP] Japan ..... 1-7135
Feb. 23, 1989 [JP] Japan ..... 1-44339

[51] Int. Cl.[5] ..... B22C 3/00

[52] U.S. Cl. ..... 106/38.22; 106/38.24; 427/135; 252/18

[58] Field of Search ..... 106/38.22, 38.24; 427/135; 252/18, 21, 22

[56] References Cited

U.S. PATENT DOCUMENTS 3,213,024 10/1965 Blake et al. ..... 106/38.22
3,341,454 9/1967 Chor ..... 252/21
3,454,495 7/1969 Schneider ..... 252/21
3,993,620 11/1976 Yamanishi et al. ..... 106/38.22 X
4,038,088 7/1977 White et al. ..... 106/38.24
4,148,970 4/1979 McIntosh et al. ..... 252/18 X
4,202,523 5/1980 Radtke ..... 427/135 X
4,264,052 4/1981 Radtke ..... 427/135 X
4,310,427 1/1982 Wun ..... 252/21

FOREIGN PATENT DOCUMENTS 0008497 1/1981 Japan ..... 252/18

*Primary Examiner*—Karl Group
*Attorney, Agent, or Firm*—Armstrong, Nikaido, Marmelstein, Kubovcik & Murray

[57] ABSTRACT

A die-casting powdery mold releasing agent according to this invention is a mold releasing agent comprising a mixture of powdery or granulated mold releasing base material composed of an inorganic compound as used for lubricant in a solid form and an organic compound giving adhesive property to the mold releasing agent, the both having powdery or granulated configurations, or configurations in which the organic compound is covered on the mold releasing base material. The mold releasing agent allows production of castings of high quality, in the die-casting method with good workability and without worsening environmental situations.

3 Claims, No Drawings

DIE-CASTING POWDERY MOLD RELEASING AGENT

BACKGROUND OF THE INVENTION

1. Industrial Useful Field

This invention relates to a mold releasing agent which is used by being sprayed onto an inside surfaces of molding die in a die-casting work.

2. Prior Art

A die-casting method is being utilized widely in manufacturing various parts for automobile and electrical equipment because cast parts of high precision can be manufactured continuously and in large quantities by this method. And, in this die-casting method, a mold releasing agent is used in order to prevent a molding die from direct contact with molten metal for avoiding seizure and for betterning release of products from dies.

The die-casting mold releasing agent is generally classified into two principal groups: a water soluble mold releasing agent and a water insoluble mold releasing agent. Among these agents, the water insoluble mold releasing agent includes problems from standpoint of safety because of its large danger due to smoke and flammability so that the water soluble mold releasing agent is being used frequently. The water soluble mold releasing agent is generally composed of mold releasing base materials such as water, mineral oil etc., to which silicon oil, synthetic or natural wax, fats and oils, fatty acid ester etc. for use is surface active agent or extreme pressure providing agent, are annexed.

PROBLEMS TO BE SOLVED BY THE INVENTION

Incidentally, with a progress of die-casting technology in recent years, there has been an increasing demand for a mold releasing agent to obtain products of high quality with better workability. However, it has become impossible to satisfy this demand by using the water soluble mold releasing agent. Namely, the water soluble mold releasing agent has included problems that control of die temperature has been difficult due to its water solubility and there has been a high possibility of defects arising in product insides due to remaining water. Further, there has been a problem that liquid-waste treatment has become required for prevention of water pollution to induce increases in various expenses for plant and equipment investment. Therefore, a strong demand for a mold releasing agent of new type has arisen.

SUMMARY OF THE INVENTION

This invention has been made on the basis of detailed studies and systematic experiments in due consideration of the foregoing situations. An object of this invention is to provide a die-casting mold releasing agent for obtaining cast products of higher quality with better workability and without worsening environmental conditions; namely, in more concrete form, to provide a mold releasing agent which can securely prevent seizure of products and occurrence of inside defects to improve die-releasing ability of products from dies, can be easily removed from die insides and product surfaces after use, and permits no generation of gas during casting and no pollution of water after casting.

The mold releasing agent according to the invention is a mold releasing agent comprises a mixture of powdery or granulated mold releasing base material composed of an inorganic compound as used for lubricant in a solid form and an organic compound giving adhesive property to the mold releasing base material, the both having powdery or granulated configurations, or configurations in which the organic compound is covered on the mold releasing base material.

DETAILED DESCRIPTION OF THE INVENTION

The most outstanding feature of this invention is that the mold releasing base material has the powdery or granulated configuration.

It is effective to select a content of organic compound in relation to inorganic compound from a range of 0.1 through 45 weight percent. The reason is that the adhesion effect of the inorganic compound to metal mold insides is not enough when the content is smaller than 0.1 weight percent, and a built-up occurs to cause a difficulty in removing the mold releasing agent from the metal mold insides, i.e. a decrease in mold releasing efficiency or a worsening of dimensional accuracy of product when the content is larger than 45 weight percent.

There is no limitation to the mold releasing base material for use in the present invention, provided that they are composed of solid inorganic compound used for lubricant.

Generally; boron nitride, mica, metal oxide and silicon nitride are preferably used therefor. However, another well known solid lubricants may be used therefor, which have conventionally been used as the mold releasing agent, such as molybdenum disulfide, graphite etc. These inorganic compounds have powdery or granulated configuration, and only one kind of them or two or more kinds thereof are used in combined form.

Further, there is no special limitation to the organic compounds used for the present invention, provided that they have characteristics of giving the adhesive and bonding properties to the foregoing inorganic compounds. Generally, metallic soap or high molecular compound are preferably used therefor. Carboxylic acid construction annexed with sodium, calcium, barium, lithium, potassium, magnesium or zinc is used for the metallic soap; and polyethylene, polypropylene, epoxy resin, silicon resin, phenol resin, acrylate resin, alkyd resin or polystyrene are preferably used for the high molecular compound. These organic compounds are mixed with the mold releasing base material in the powdery or granulated configuration or mixed with it in a heated molten state. Accordingly, in the mold releasing agent according to the present invention, both the mold releasing base material and the organic compound are formed into the powdery or granulated configuration, or the organic compound is covered on the powdery or granulated mold releasing base material. Incidentally, only one kind of the above-mentioned organic compounds is used, or two or more kinds of them are used in combined form. A combination of the metallic soap with the high molecular compound may be used.

FUNCTION

In the die-casting powdery mold releasing agent according to the present invention, the mold releasing base material has at least the powdery or granulated configuration so that the product is surely separated from the metal mold inside surface at least by a particle diameter of powder or granule of the mold releasing base material at a part of the metal mold inside surface to which the mold releasing agent adheres. Consequently, the mold releasing agent adheres uniformly to the whole metal mold inside surface so that the seizure caused by the direct contact of the product with the metal mold inside surface can be avoided without fail. Further, since the mold releasing agent according to this invention is composed of the organic compound and the inorganic compound and does not include water content, no defect due to remaining water arises in the product inside surface. Accordingly, the quality of product can be improved.

Moreover, in the mold releasing agent according to the present invention, the mold releasing base material has at least the powdery or granulated configuration and does not include water content so that a tension working between the metal mold inside surface and the product is weak. Therefore, taking-out of the product from the metal mold becomes easy. Furthermore, the mold releasing agent can be removed easily from the metal mold inside surface and the product surface.

In addition, in the mold releasing agent of this invention, the mold releasing base material has at least the powdery or granulated configuration so that the material is hard to react and scarcely generates gas even if it is subjected to heat during die-casting. And, this agent does not produces water pollution after casting as encountered in case of the water soluble mold releasing agent. Therefore, worsening of field environment can be avoided and expenses for liquid-waste treatment become unnecessary to cut off maintenance cost.

EFFECT OF THE INVENTION

In this invention; the die-casting mold releasing agent comprising the mixture of the mold releasing base material composed of the inorganic compound and the organic compound is formed into the releasing agent wherein at least the mold releasing base material has the powdery or granulated configuration. Therefore, castings produced by means of the die-casting method, such as aluminum alloy and zinc alloy etc., can be surely prevented from seizures and inside defects; to be improved the quality of casting; the casting work based on the die-casting can be carried out with good workability; and the worsening of environment before and after use of agent can be fully avoided. Especially, the quality of obtained castings can be improved by settling the content of organic compound in relation to inorganic compound to the range of 0.1 through 45 weight percent.

Further; the above-mentioned effect can be enhanced still more when boron nitride, mica, metal oxide or silicon nitride is used for the inorganic compound; and when the metal soap comprising the carboxylic acid construction annexed with sodium, calcium, barium, lithium, potassium, magnesium or zinc, or the high molecular compound such as polyethylene, polypropylene, epoxy resin, silicon resin, phenol resin, acrylate resin, alkyd resin or polystyrene is used for the organic compound. And the mold releasing agents, which are usable most suitably in respective die-casting works, can be obtained by using two or more kinds of the foregoing inorganic compounds and organic compounds respectively in the combined manner.

EMBODIMENTS

Embodiments of the present invention will be described below, but the invention is not limited to these embodiments.

Following mold releasing agents (A) through (E) were obtained, casting tests based on the die-casting method were carried out by using these mold releasing agents, and items listed in [TABLE] were compared and examined.

Two kinds of mixtures: mixture wherein organic compound is mixed with inorganic compound in powdery or granulated configuration, and a mixture wherein the organic compound is mixed with the inorganic compound in a heated molten state; were obtained for the embodiments (A) through (C) of the present invention.

The two kinds of mixtures were examined and obtained results were the same for the both mixtures. Incidentally, compounds as used for the mold releasing agents (A) through (E) are those available in the market.

(A) First embodiment comprising a mixture of 95 parts of boron nitride (average particle size: 1 through 5 microns) and 5 parts of calcium stearate (B) Second embodiment comprising a mixture of 20 parts of boron nitride, 75 parts of mica and 5 parts of polyethylene (C) Third embodiment comprising a mixture of 50 parts of boron nitride, 45 parts of silicon nitride, 3 parts of barium stearate and 2 of polypropylene (D) Boron nitride only (comparison embodiment 1)

(E) Water soluble mold releasing agent containing, as major components, wax and silicon oil at a ratio of 1:80 (comparison embodiment 2)

TABLE

| | (A) | (B) | (C) | (D) | (E) |
|---|---|---|---|---|---|
| Adhesion to metal mold | ○ | @ | @ | X | ○ |
| Effect for preventing seizure | @ | @ | @ | — | ○ |
| Effect for preventing defects in product inside | @ | @ | @ | — | * |
| Effect for preventing worsening of field environment due to generation of smoke and steam | @ | @ | @ | — | * |

X: Completely non
—: Measurement impossible
*: Small
○: Intermediate
@: Large

What is claimed is:

1. A die-casting mold release agent consisting essentially of a granulated or powdery mixture of a lubricant selected from the group consisting of boron nitride, silicon nitride, molybdenum disulfide, graphite, mica and metal oxides; an organic polymer selected from the group consisting of polyethylene, polypropylene, polystyrene, epoxy resin, silicon resin, phenol resin, acrylate resin and alkyd resin; and a metal soap; wherein the lubricant is coated with the organic polymer or the metal soap.

2. A die-casting mold release agent according to claim 1, which contains 55 to 99.9 wt % of the lubricant.

3. A die-casting mold release agent according to claim 1, wherein the metal soap is selected from the group consisting of sodium, calcium, barium, lithium, potassium, magnesium and zinc salts of carboxylic acids.

* * * * *